United States Patent [19]

Malavazos, deceased et al.

[11] 3,949,203

[45] Apr. 6, 1976

[54] SELECTION MECHANISM FOR A POSTAGE METER

[75] Inventors: Arthur J. Malavazos, deceased, late of Hayward, Calif., by Gregory A. Malavazos, administrator, Newark, Calif.

[73] Assignee: A J M Research Corporation, Hayward, Calif.

[22] Filed: Apr. 3, 1974

[21] Appl. No.: 457,594

[52] U.S. Cl. ..... 235/101; 235/58 P

[51] Int. Cl.² ..... G07G 1/00

[58] Field of Search ..... 235/101, 58 P, 60 P

[56] References Cited

UNITED STATES PATENTS 3,823,666 7/1974 Hanson ..... 235/58 P

*Primary Examiner*—Stephen J. Tomsky

*Attorney, Agent, or Firm*—Robyn Wilcox

[57] ABSTRACT

This invention relates to a selection mechanism for a postage meter in which a single Thomas-type mutilated drum actuator is rigidly mounted on a hollow cylindrical drive shaft on which is also mounted the postage meter printing head, and comprises a series of selection bars lying longitudinally of the drive shaft and angularly therearound, each of which bars is set by a suitable manual positioning means, such as a selection wheel, each such bar carrying a yoke to position a driven gear of a first register to be driven by the actuator, a like series of auxiliary setting bars, each of which is rigidly yoked to the respective first setting bar and which carries a yoke for setting a register drive gear of another register of a postage meter. The main setting bar, at its forward end, is provided with gear teeth which drive a gear train that meshes with a rack carried by the actuator drive shaft to set the mechanism in the print wheel.

14 Claims, 8 Drawing Figures

SELECTION MECHANISM FOR A POSTAGE METER

BACKGROUND OF THE INVENTION

The present invention can be considered as actually, if not legally, a division of my copending application entitled "Arithmetic Unit for a Postage Meter", filed on even date herewith, U.S. Pat. No. 3,890,491 issued June 17, 1975, and as such, is complementary to the mechanisms described in my copending applications entitled "Register for a Postage Meter", filed on even date herewith, U.S. Pat. No. 3,876,870, issued Apr. 8, 1975; "Print Head for a Postage Meter", also filed on even date herewith, U.S. Pat. No. 3,918,361, issued Nov. 11, 1975; and "Lock for Selection Mechanisms for a Postage Meter", filed on even date herewith, U.S. Pat. No. 3,892,355, issued July 1, 1975.

Postage meters are made under strict regulations prescribed by the U.S. Post Office which require, among other things, that a value selected for the meter must be accurately set in the value printing stamp of the meter and accurately set into each of two registers: one in which the values are accumulated known as the "ascending register", and one in which a value of the stamp is subtracted from the value set by the Post Office at the time of payment for postage, known as the "descending register"; and a mechanism which locks the meter against operation when the value in the descending register falls below that which could be set into the meter by the operator. The particular mechanism described and claimed herein relates to the selection mechanism for such a postage meter. For purposes of exemplification only, one order of the selection mechanism will be described, although it will be understood, as explained hereafter in the specification, that there will be a plurality of such mechanisms, one for each order of the registers, into which values may be set and a print head in which it is desired to select a value to be registered and printed. It is well-known in the art that the Post Office with which a meter is registered will, upon the payment of an amount to cover postage desired by the user, reset the descending register from time to time, but the values accumulated in the ascending register are never changed except by machine operation.

Other requirements of the Post Office are that the meter must be accurate in all aspects of its operation. It should be ruggedly constructed to withstand long and hard usage and it must be relatively trouble-free. It is well-known that a meter is so encased in its cover that it cannot even be repaired and the mechanism cannot be changed in any way except to change what are known as "slogan" dies on the print head and except that the descending register can have its setting changed at the Post Office when a Post Office official unlocks access to that register — any other repair or change in the meter requires that the meter be officially taken out of service by the distributor and repaired in a facility that is subject to Post Office inspection. Hence, it is essential for a satisfactory postage meter to be rugged and trouble-free in its operation.

OBJECTS

It is an object of the present invention to provide a selection mechanism that will accurately set identical values in both the ascending and the descending register and the print head of a postage meter.

It is another object of the present invention to provide a selection mechanism that is very rugged and simple in construction so that its operation will be long-lasting and trouble-free.

It is a further object of the present invention to provide a selection mechanism for a postage meter that is extremely accurate and can be selectively set for either automatic restore to a 0 value during each cycle of operation or to lock a value in a set position for an indefinite number of cycles.

It is still a further object of the present invention to provide a selection mechanism that can be selectively set order-by-order from the lowest to the highest for automatic restore at the end of each cycle of operation or can be set for repeated operations on the same value easily and safely order-by-order from the highest to the lowest.

Another object of the present invention will be to provide a better postage meter than is now available.

These and further objects of the invention will be apparent from the description of the selection mechanism in the following specification when construed in connection with the accompanying drawings in which:

FIG. 8 is a detail of a locking plate taken on a transverse vertical plane, such as along the plane indicated by the line 8—8 of FIG. 1.

Figures 1, 2:
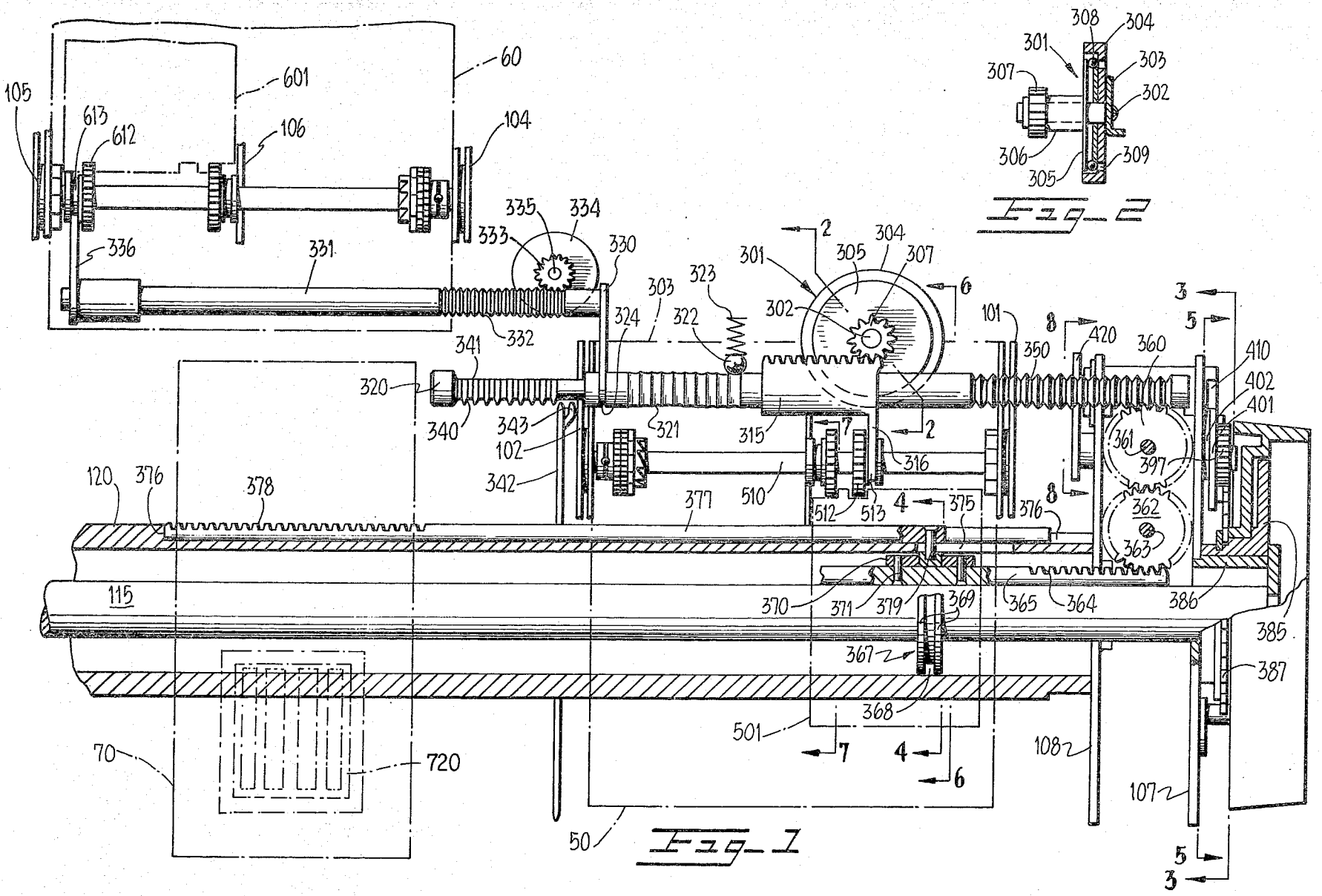
FIG. 1 is a longitudinal cross-sectional view of one order of the selection mechanism of the present invention.
FIG. 2 is a cross-sectional view, partly in cross-section, of the value setting wheel shown in FIG. 1, such as along the plane indicated by the line 2—2 of FIG. 1.
Figure 2:
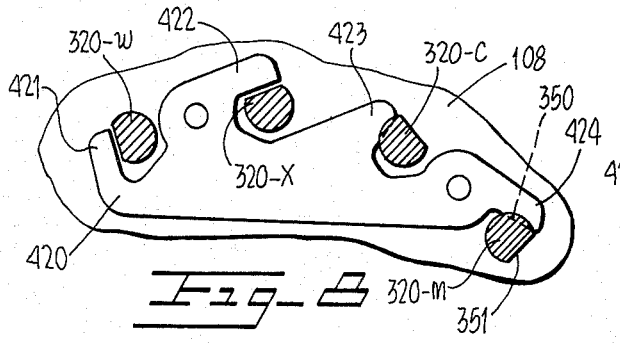

The mechanism of the present invention is mounted in a frame structure which includes, among other things, a front frame plate 101, an intermediate frame plate 102, an ascending register front supporting plate 104, and an ascending register rear supporting plate 105, end plate 107, and an auxiliary plate 108, all shown in FIG. 1. These various frame plates and others, are held in rigid and spaced relationship by a number of tie bars, not shown in this application. A fixed round shaft, or axle, 115 is rigidly supported at its front end in auxiliary plate 107 and its rear in a frame member not shown in these drawings. The main drive shaft 120 is a hollow cylinder surrounding the axle 115 and is journalled in suitable bearings, not shown herein, and is also held in spaced relationship to the axle by a plurality of grooved disks 367, which also serve to properly position the setting bars 365 lying between the axle 115 and the drive shaft 120 and which are operative to set the mechanism in the print head 70, as hereinafter described. These disks are non-rotatably mounted on the fixed axle 115 and engage their respective pins which rotate with the drive shaft 120. It will be understood that there are a series of such grooved disks 367 (11 in the preferred form of the present invention) throughout the length of the drive shaft 120, therebeing one for each order of the selection mechanism, one for setting the month of the date stamp, two for setting the days of the date stamp and four for setting the various mechanisms which control the operation of the date stamp for either printing or non-printing; control printing or non-printing of the "bulk rate" die, and likewise control the printing or non-printing of two slogan dies, as is more fully described in the copending application entitled "Print Head for a Postal Meter" mentioned above.

Figure 9:
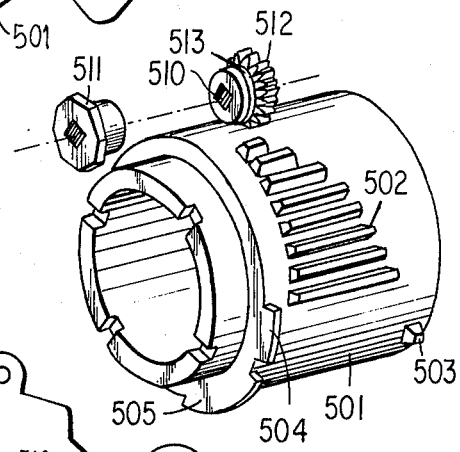

The various devices which are controlled by the selection mechanism are shown in dotted lines in FIG. 1 and include the Thomas-type mutilated gear actuator 501, the descending register 50 described in the copending application entitled "Register for a Postage Meter" above mentioned; an identical Thomas-type mutilated gear actuator 601, an ascending register 60; and a print head 70. Such a mutilated gear actuator comprises a gear hub 501 as shown in FIG. 9, having thereon nine partial teeth 502 of incrementally increasing length. Associated with the gear teeth 502 is a driving gear 512, to be described hereafter, which is slidably mounted on a square shaft 510 which may be positioned longitudinally of the drum 501 whereby the teeth of gear 512 can be engaged by one or more of the teeth 502 so as to enter values of 1 to 9 from the register into the registration mechanism by the positioning of gear 512. The drum 501 also includes a blank space, not identified, which, when in opposition to the gear 512, will cause no rotation of the gear 512. The drum also contains a tens-transfer tooth 503 trailing the last and longest gear tooth 502 and Geneva blocks 504, 505 cooperate with a Geneva wheel 511. The blocks and wheel are operative, first to block rotation of the square shaft 510, then permit a transfer if one is called for, then again block the rotation of shaft 510.

The selection mechanism of the present invention is set by a setting wheel 301 (FIG. 1) which is rotatably mounted on a stud 302 affixed to a longitudinal bar 303 rigidly mounted between the front frame plate 101 and the rear plate 102. Since operators occasionally let their hands rest on setting mechanisms, and since in this invention the setting wheel 301 is directly geared to the setting mechanism, damage to the machine might occur when the machine is set for an automatic restore of values during the cycle of operation, unless some means were provided to prevent such misoperation. It is therefore preferred that the setting wheel 301 have a yieldable connection with its associated gear 307 and this is preferably provided by the mechanism shown in FIG. 2. The setting wheel 301, in the preferred form, comprises a plastic dial 304 and associated therewith a thin disk 305 made of spring steel to which is affixed an integral collar 306 and a gear 307. A plurality of balls 308 are placed between the spring steel disk 305 in the wheel, preferably being nested in the apertures 309 in the dial 304. Thus, the rotation of the outer wheel 304 will normally cause a like rotation of the gear 307 but the dial 304 will turn idly if manually operated while the selection mechanism is locked in a value setting position, or will idly remain fixed if manually held and the setting mechanism is being restored automatically toward the end of a cycle of operation. Preferably there will be no indicia on this wheel, the operator relying on a check dial 334.

Each gear 307 of a setting wheel 301 meshes with a rack 315 which is rigidly affixed to a selection bar 320 that is mounted in suitable bearings carried by the frame plates 101, 102 and 107 for both longitudinal and rotating movement for purposes to be hereinafter described. Each rack 315 carries a yoke 316 that embraces a slot 513 in a nine-tooth gear 512 mounted on a square shaft 510, whereby the gear 512 will be differentially set opposite a selected value tooth 502 on the mutilated drum 514, as more fully described in the application entitled "Register for a Postage Meter" above referred to.

The selection bar 320 is provided with a series of ten circular detent grooves 321 with which is associated a spring ball detent 322 that is resiliently pressed against the bar 320 by a compression spring 323, the ball and spring being held in a suitable cylindrical holder, not shown, carried by the frame of the device. Thus, the bar 320 can be longitudinally adjusted by rotation of the wheel 301 against the force of spring 323, and once adjusted, will be resiliently held in that position by the force of that spring.

Figure 3:
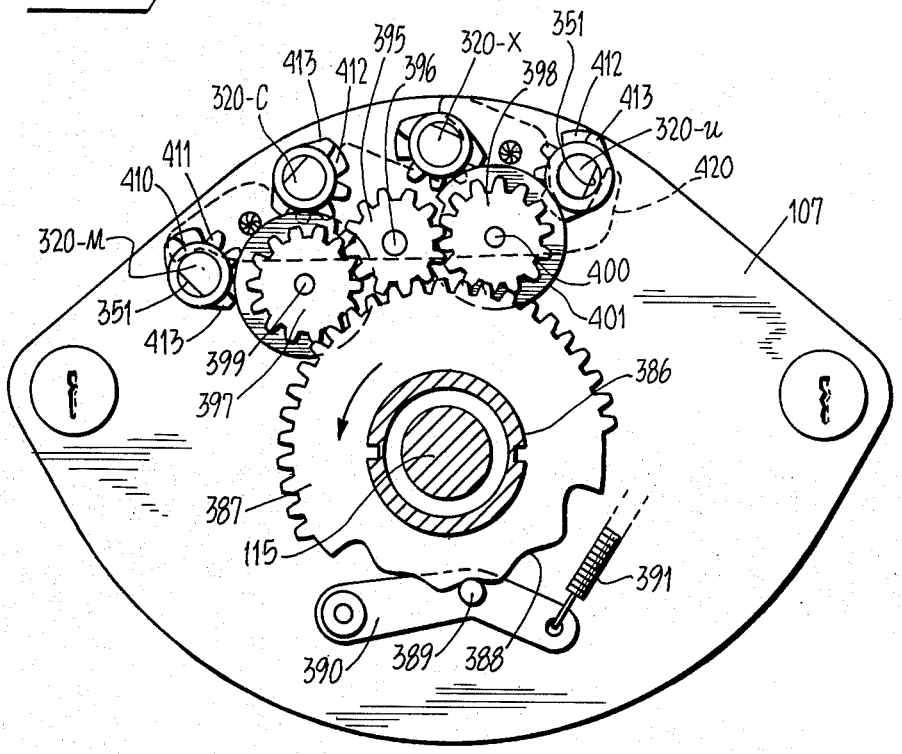
FIG. 3 is a front view of the selection mechanism shown in FIG. 1, taken on a transverse vertical plane at the forward end thereof, such as along the plane indicated by the line 3—3 of FIG. 1.
Figure 6:
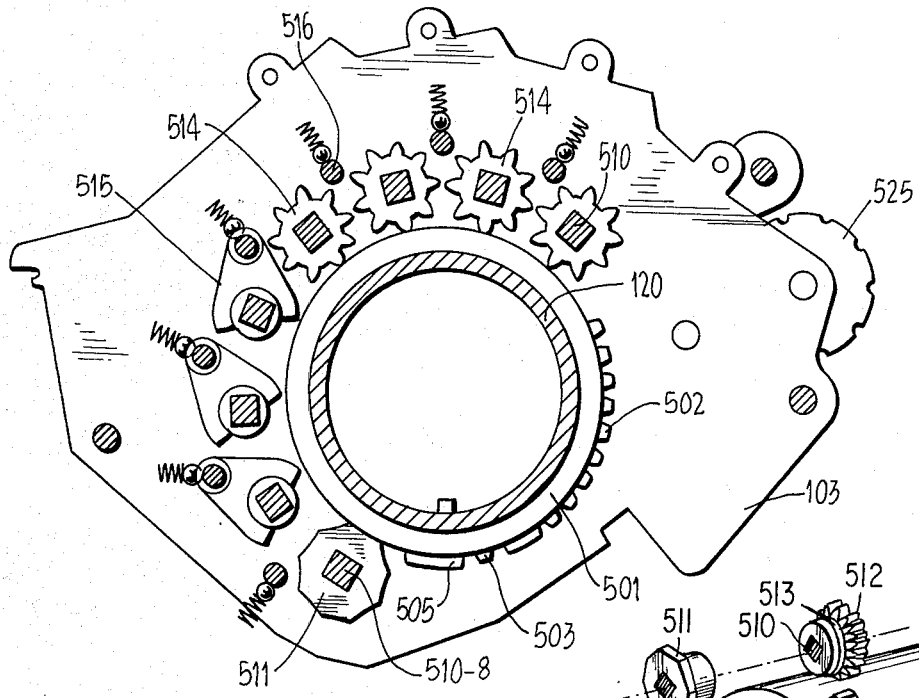
FIG. 6 is a transverse cross-sectional view of the front section of the selection mechanism, such as taken along the plane indicated by the line 6—6 of FIG. 1.
Figure 7:
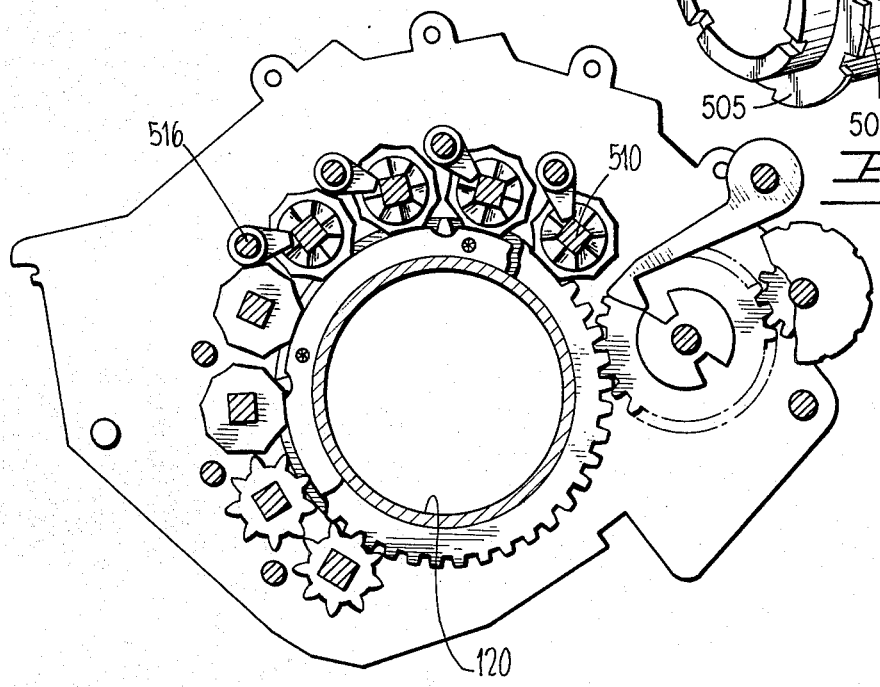
FIG. 7 is a transverse cross-sectional view of the rear section of the selection mechanism, such as taken along the plane indicated by the line 7—7 of FIG. 1.

It will be understood that there is a setting wheel 301 and an associated selection bar 320 for each order of the selection mechanism, as shown in FIGS. 6 and 7. In the preferred form of this invention there are four such setting mechanisms, so that a value of $99.99 may be printed and set into the register (or a value of $9.99½ in those few instances in which a user desires a ½ cent mechanism). The bars 320 and setting wheels 301 are angularly placed around the actuator 514 as also shown in FIG. 3. Since the mechanisms of all of these selection setting devices are identical, it is believed that only one need be described. It will be understood that there are four of the mechanisms shown in FIG. 1, angularly arranged around the main drive shaft 120 as shown in FIGS. 3, 6 and 7.

Rearwardly of the detent grooves 321 on bar 320 is an annular notch 324. The groove 324 is embraced by an ascending register yoke 330 which is rigidly secured to an ascending register setting bar 331. The forward end of the ascending register setting bar 331 is provided with a series of circumferential teeth 332. These teeth mesh with a gear 333 which is rigidly secured to a check dial 334 mounted on a shaft 335. The check dial 334 is provided with indicia showing the values from 0 to 9, inclusive, and is visible through a suitable window in the cover, not shown. The operator can thus determine the value set in the register by looking at the check dials 334 which at all times will correctly register the value set in the mechanism. No indicia is required in the setting wheel 301, as that can "slip" with respect to the value set in the mechanism and hence it is preferred that this be left without indicia.

The ascending register selection bar 331 is suitably journalled in the machine for axial, or longitudinal, movement, such as in bearings in the ascending register frame plates 104, 105 and 106. Adjacent the rear end, the bar 331 carries a yoke 336 rigidly secured thereto by any suitable means, such as a pin, not identified. The outer, or Y, end of the yoke 336 engages a notch 613 in the hub of a selection gear 612 in the ascending register, which gear, hub and latch are identical with that previously described in connection with the descending register 50 and its mutilated drum actuator 501. It will be understood by those skilled in the art that the gear 512 in the ascending register will drive the ascending register 60 to enter a value additively in that register while the descending order selection gear 512 is operative to subtract the value from the descending register 50.

Adjacent the rear end of the main setting bar 320 is a series of nine circumferential rack teeth 340. As shown in FIG. 1, this section of the bar has a flattened surface 341. In the drawing it would appear that this flattened surface 341 lies at the very top of the bar in the normal position of the bar. However, in actual construction, it is preferred that this flattened surface be slightly off to the side, being placed 107° from the bottom of the rack when the bar 320 is in its normal position. Associated with the rack 340 is a restore cam 342, having a series of nine projecting cam faces 343 so angled as to restore the selection bar 320 one tooth, or step, forwardly as a cam face engages one of the teeth 340. These nine restore cam faces 343 are angularly positioned that they trail all of the teeth on the mutilated drum actuator 514. Hence, after digitation is completed, the cam 342, 343 will restore the bar 320 to its 0 position, one step at a time, before the completion of the cycle of operation. On the other hand, if the selection bar 320 is rocked through an angle of 107°, the flat 341 will lie opposite the restore cam disk 342 and its nine camming teeth 343 and the bar will not be restored automatically. It is seen from this figure that when the setting mechanism stands at a 0 value, the cam lies opposite a blank space in the selection bar 320.

Adjacent the forward end of the main selection bar 320 is a second series of circumferential rack teeth 350. While the setting bar can only be moved nine steps to enter a maximum value of nine in any order, it is preferred to provide about double that number of teeth in order to lock the bar in a non-restore position by the means hereinafter described. At this point it can be noted that this series of rack teeth is flattened as at 351 (FIG. 3), which permits the bar to be moved past a locking plate 420. In the normal position shown in which the flat 351 is facing the plate 420, the teeth 350 and plate 420 do not touch, but when the bar 320 is rocked through an angle of 107°, a space between adjacent teeth 350 will engage the edge of the plate 420, thereby locking the bar 320 in its adjusted position, as is shown in FIG. 8 in connection with selection bars **320-*c* and 320-*m*.**

Figure 4:
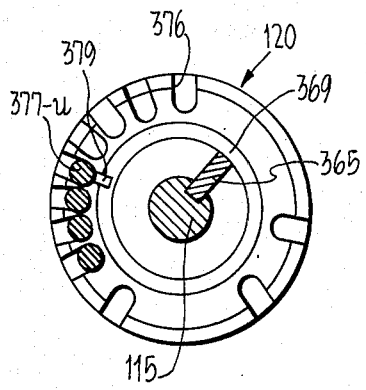
FIG. 4 is a transverse cross-sectional view of the main drive shaft, such as on the plane indicated by the line 4—4 of FIG. 1.

Whether or not the shaft 320 is in the automatic restore position shown in FIG. 1, or in the fixed position just mentioned, the gear teeth of each setting or selection bar 320 meshes with a first idler gear 360 rotatably mounted on a pivot stud 361. The gear 360, in turn, meshes with a second idler 362 rotatably mounted on a stud 363. The two gears 360 and 362 are mounted radially of the fixed axle 115 and drive shaft 120, as shown in FIG. 1. The second idler 362 meshes with a rack portion 364 of a setting bar 365 which runs lengthwise of the fixed axle, or bar, 115 and within the rotating cylindrical drive shaft 120. Each bar 365 is held in its proper angular position by a longitudinal groove in the fixed axle 115, as shown in FIG. 4. The bars 365 are therefore held against rotation of the drive shaft 120 but are free to move axially along the fixed bar 115. Each of the bars 365 carries at an intermediate point a grooved disk 367. Each grooved disk 367 has a central annular groove 368 and a pair of side walls 369, as shown in FIG. 1. The grooved disk 367 is mounted on its respective bar 365 by means of a pair of collars 370 tightly holding the grooved disk between them, each of the collars being riveted to the bar 365 by suitable rivets 371. In order to prevent interference between the different ordinal collars 367 and their clamping rings 370, each order of the selection mechanism, of which there are preferably four in the machine of this invention, is spaced from the next by an increment of about ten tooth-spaces of the teeth 364. It will be understood that while each bar 365 can only move through nine differential steps, it is desired that a little more space be allowed to prevent every possibility of contact between adjacent rings 370. The rings 367 rotatably engage the interior wall of the main drive shaft 120.

Longitudinal grooves 376 are formed on the outside wall of the main drive shaft 120. A bar 377 is placed in each of said slots 376, and their rear ends are provided with gear teeth, or racks 378. In the forward end of each bar 377 a pin 379 is riveted in opposition to the grooved disk 367 of the respective bar 365, as shown in FIG. 1, and is adapted to engage the groove 368 in the grooved disk 367 through a slot 380 in the wall of the hollow shaft 120. Thus, as a main selection bar 320 is moved to a differential position selected by the operator, the rack teeth 350, through the medium of idler gears 360 and 362, move the interior rack bar 365 forwardly an exactly equal differential amount. By means of the grooved disk, or collar, 367 and pin 379, the rack bar 377, lying in the ordinally related groove in the exterior wall of the main drive shaft 120, is moved a like amount. When the main drive shaft is rotated to enter the values into the respective registers 50 and 60 and rotate the print head 70 to print the proper stamp on mail matter, the rack bar 377 is held in an adjusted position as its pin 379 travels completely around a circle by its constant contact with the wall 369 of the grooved disk 367.

It would appear from FIG. 1 that the interior bar 365 and the exterior bar 377 lie in the same angular plane. However, this figure has been distorted to show that the two are functionally associated. Actually, as shown in FIG. 4, the two are angularly separated. As a practical matter, it is preferred to have the print wheels 720 (FIG. 1) and the indicia for the encompassing stamp to trail the printing position (bottom of the figure) by a very small angle, so that it may contact an ink supply device and immediately print the stamp on the mail close to the leading edge of a letter (going from left to right in the preferred form of meter). However, the setting mechanism is preferably placed on top of the machine, with the units order on the extreme right as an operator faces the machine. The angular displacement of the two setting bars 365 and 377 is readily accomplished by the use of the slotted disk 367. Since the disk 367 is rigidly fastened to the inner bar 365, it moves axially of the axle 115 and drive shaft 120 and in a plane perpendicular to both, as the inner setting bar 365 moves. Also, since the disk 367 is a complete circle, the pin 371 (regardless of where it is angularly situated in its slot 368) is effective to set the outer setting bar 377 a like amount. Thus, the manual setting devices can be arranged in the most advantageous position on the outside of the cover and be directly connected to its respective inner setting bar 365 and the outer setting bar 377 can be placed where most practical in the printing head 70.

It may be mentioned at this point that each cycle of operation requires a complete circle of 360°. Whether the meter is set for a single cycle of operation and the consequent automatic restore of the selection mechanism or is set for a single unchanging value for a continuous series of operations, the drive shaft will automatically complete its operation and stop at the end of each full rotation. The means for cycling the drive shaft 120 is not pertinent to this invention, but it is understood by those skilled in the art that it is controlled by an incoming piece of mail triggering the operation of the main drive shaft. When stamping a continuous series of mail, the trigger is operated by the next piece of mail before the cycle is completed, so the machine need not stop and start.

The means for rotating the main selection bar 320 to set it for either automatic restore or fixed selection will now be described. It is seen in FIG. 1 that an interior hand wheel 385 is rotatably mounted on a collar 386 affixed to the forward end plate 107. Adjacent the inner end of the hub of hand wheel 385 is a partial gear 387 (FIG. 3). This partial gear 387 can be resiliently detented in any adjusted position by means of five detent notches 388, one of which will be engaged by a pin 389. The pin 389 is carried by a pivoted arm 390 that is resiliently biased into engagement with the partial gear 387 by means of a tension spring 391. The partial gear meshes with an idler gear 395 that is pivotally mounted on the plate 107 by any suitable means, such as stud 396. The idler 395 meshes with a pair of locking gears 397 and 398, which are identical in construction, but since the locking gears shown are not similarly set, they are given distinguishing reference characters. These gears are respectively mounted on studs 399 and 400 carried by the frame plate 107. Each of the gears 397 and 398 carry a Geneva disk 401 and a three-tooth gear segment 402 (see FIG. 5). The three elements of gear 397 and 398 or its associated Geneva wheel 401 and three-tooth gear segment 402 are affixed together to form an integral structure. The gear 397 and its assembly are effective to sequentially lock the thousands order selection bar **320-*m* and the hundreds order selection bar 320-*c*, while the gear 398 and its assembly are effective to sequentially lock the tens order selection bar 320-*x* and the units order selection bar 320-*u***. (Where it is necessary to distinguish between orders of the selection mechanism, the suffix *u* is used to indicate the units order of the selection bar 320, the suffix *x* to indicate the tens order, the suffix *c* to indicate the hundreds order, and the suffix *m* to indicate the thousands order selection bars.)

Figure 5:
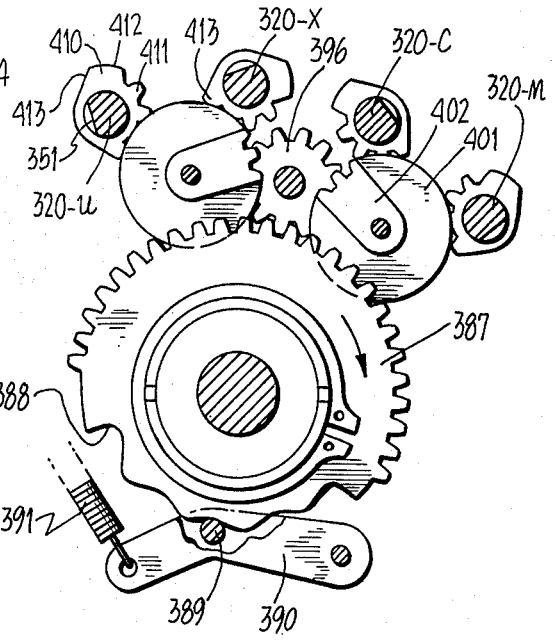
FIG. 5 is a transverse cross-sectional view of the mechanism for setting the selection mechanism order-by-order for either automatic restore at the end of each cycle of operation or for locking a value therein for an indefinite number of cycles, and is the back side of the element shown in FIG. 3, such as along the plane indicated by the line 5—5 of FIG. 1.

Associated with the wheels 397 and 398 and their integral Geneva wheels 401 and three-tooth gear segments 402, are a set of gear sleeves 410 mounted on the front end of the selection bars 320 of the four orders into which values can be selected. The gear sleeves are slidably but non-rotatably mounted on the respective bars by suitable keys. These mutilated gears comprise a pair of central gear teeth 411 (FIGS. 3 and 5). These gears have a width or thickness equal to the thickness of the Geneva disk 401 and the three-tooth gear segment 302. Adjacent the two central teeth 411 and lying on either side thereof is a long half-thickness section 412 having the radius of a gear tooth and extending angularly for a distance equivalent to the second tooth from the adjacent tooth 411. The trailing edge of this section 412 is a full width tooth 413. In the normal state of affairs, the Geneva wheel 401 will lie between the trailing gear tooth 413 and the first adjacent central tooth 411 and overlie the web section 412, thereby preventing rotation of the mutilated gear 410. When the integral three-tooth gear 402 and Geneva 401 is rotated toward the other position, the first gear tooth of the three-tooth gear segment will engage the trailing full tooth 413 and then drive the mutilated gear 410 through an angular distance of the two central gear teeth 411, or about 107° on the preferred form of the invention, whereupon the Geneva wheel 401 again comes between the trailing full width tooth 413 and the adjacent central tooth 411. Thus, the gear 410, and consequently its selection bar 320, can be rotated between two angular positions 107° apart and will be detented in the respective positions until again rotated by manipulation of the hand wheel 387.

Whenever the selection bar 320 is rotated from the position shown in FIG. 1 by the means just described, the flat 351 on the front end of the selection bar, and the flat 341 on the rear end of the bar, are rotated through an angle of 107°. Such rocking either sets the particular selection bar 320 to an automatic restore or a locked value position. In the latter position, the selection bar 320 cannot be moved until it is rotated back to the automatic restore position. In FIGS. 3 and 5, the units and tens orders are unlocked and the hundreds and thousands orders are locked. Locking is secured by gear teeth 350 on the forward end of the selection bar 420 engaging a locking plate 420 (FIG. 8) that is rigidly mounted on the frame plate 108. The locking plate 420 is shown in dotted lines in FIG. 3 and in full lines in FIG. 8. In both figures the selection bars **320-*u* and 320-*x* are shown in the position indicated in FIG. 1 in which the flats 351 on those selection bars lie opposed to arms 421 and 422, respectively, of the locking bar 420, while the flats 351 on the hundreds and thousands order have been rotated to lie angularly from said plate. Thus, the flats 351 of the selection bars 320-*u* and 320-*x* do not touch plate 420, but arms 423 and 424, respectively of the plate 420 are caught between adjacent teeth 350 on selection bars 320-*c* and 320-*m*. When a selection bar 320 is so rocked, the associated arm of the locking plate 424 will engage between two adjacent teeth 350 on the bar 320** and hence it cannot be moved in either direction.

By the means just described, the selection mechanism of the present invention can be set order-by-order from the highest to the lowest from an automatic restore position into one in which automatic restoring is impossible and the selection mechanism is locked in its adjusted position. The selection bars 320 are locked in an adjusted position from the highest order to the lowest, and can be unlocked from the lowest order to the highest.

It is believed obvious that many modifications can be made in the present invention. For example, both the descending register 50 and the ascending register could be driven from the same actuator 514, or even from the same register drive shaft 510, but the Post Office prefers a separate actuator for each register. Again, the sizes of the gears and the number of their teeth is usually not important and could be changed. These and other changes are believed within the scope of the present invention and accordingly, an interpretation of the claims should be commensurate with the invention.

What is claimed is:

1. In a postal meter having:

a. a descending register and an ascending register;

b. a single Thomas-type mutilated drum actuator for each register;

c. a printing head having settable value print wheels; and d. a drive shaft for rotating said actuators and mounting said print head;

e. a selection mechanism comprising:

1. a plurality of ordinally arranged register driving gears arranged concentrically around each of said actuators and movable parallel thereto;

2. a manually settable bar for individually setting the ordinally identical ones of said driving gears for both registers in selected value positions;

3. ordinally arranged rack means mounted on the exterior of said drive shaft for setting the value print wheels carried by the printing head;

4. means connecting each settable bar to its ordinally related rack means for causing movement of the latter differentially with the movement of the manual means; and 5. means for maintaining the said connecting means in engagement with said rack means and said bar throughout a cycle of operation.

2. The apparatus of claim 1 wherein the means for maintaining the connecting means in engagement with said rack means and said settable bar comprises:

a. an auxiliary rack member;

b. a gear train connecting said settable bar to said auxiliary rack member;

c. a grooved disk mounted on said auxiliary rack member; and d. a pin mounted in said rack means and engaging the groove in said grooved disk.

3. The apparatus of claim 1 comprising also a means driven by said shaft and operating on said settable bar for returning said register driving gears at the end of a cycle of operation to a zero position.

4. The mechanism of claim 3 comprising also a means for disabling said returning means.

5. The apparatus of claim 1 comprising means cooperating with said settable bar for locking said settable bar in an adjusted position.

6. The apparatus of claim 5 comprising also means for disabling said locking mechanism.

7. The apparatus of claim 1 comprising in addition means driven by said shaft and operating on said settable bar for restoring said register driving gears to a zero position subsequent to the entry of value into the registers and the printing of a value by the print head, and means associated with said settable bar for disabling said restoring mechanism and locking said register driving gears in an adjusted position.

8. The apparatus of claim 7 wherein the restoring means comprises a rack on said settable bar, a restore cam on said drive shaft for feeding said rack step-by-step toward a zero position during the latter portion of a cycle of operation, means for rocking said settable bar to displace said racks from engagement with said restore cam, and means for locking said settable bar in an adjusted position when so rocked.

9. In a postal meter having an ascending register and a descending register, a hollow cylindrical drive shaft, a printing head mounted on said drive shaft, and a single Thomas-type mutilated drum actuator having nine differentially lengthened teeth on the periphery thereof for each register, and a selection mechanism comprising in each order:

1. a selection bar lying outside the periphery of and movable longitudinally of the axis of the mutilated drum actuators;

2. manual means for setting said bar in a selected value position;

3. means for detenting said bar in a differentially adjusted position;

4. a register driving gear adapted to be moved parallel to the periphery of each of the said actuators;

5. means attached to said bar for setting the ordinally related register driving gears differentially with respect to their respective mutilated drum actuator;

6. means set by the differential movement of said bar for displaying the value to be printed and registered;

7. an exterior rack means mounted on the exterior of said drive shaft for setting the value print wheels;

8. an interior rack lying within the hollow drive shaft for controlling the operation of said exterior rack;

9. means for continuously connecting said interior rack to said exterior rack for causing movement of the latter differentially and in like manner with the movement of the interior rack; and 10. means for continuously connecting said selection means to said interior rack, whereby the differential setting of the selection bar will cause a like differential setting of the exterior rack.

10. A selection mechanism for a postage meter having 1. a Thomas-type mutilated drum actuator;

2. selection gears longitudinally displaceable along said drum;

3. a descending register driven by said selection gears;

4. a second mutilated drum actuator for an ascending register;

5. longitudinally displaceable selection gears movable along said second drum;

6. an ascending register driven by said lastmentioned selection gears;

7. a printing drum for printing postage on mail matter;

8. a hollow cylindrical drive shaft carrying one of said actuators and said drum and driving the other drum;

said selection mechanism comprising in each order:

a. a selection bar;

b. manual means for differentially adjusting said selection bar;

c. means carried by said selection bar for adjusting the descending register selection gear along its mutilated drum actuator and for adjusting the ascending register selection gear longitudinally along the mutilated drum actuator for the ascending register;

d. means for detenting said bar in an adjusted position;

e. means for displaying the differential value set in said selection bar;

f. a restore cam having nine cam faces to restore said selection bar step-by-step to its zero position;

g. a rack on said selection bar and in one angular position of said rack adapted to be engaged by said restore cam to restore said bar to its zero position and in another angular position of said selection bar to be disengaged from said restore cam; and h. manual means for rotating said selection bar.

11. The apparatus of claim 10 comprising also:

a. a latching plate;

b. a second rack on said bar in the first angular position of said bar to be disengaged from said locking plate and the second angular position of said bar to engage said latching plate to prevent movement of said bar.

12. The apparatus of claim 11 comprising also:

a. an interior value setting rack mounted in the interior of said cylindrical drive shaft;

b. a gear train for connecting said interior rack to one of said racks on said selection bar;

c. an exterior bar journalled within a slot in the exterior wall of said main drive shaft; and d. means for connecting said last mentioned rack with said interior rack through the wall of said cylindrical drive shaft.

13. A selection mechanism for a postage meter having 1. a Thomas-type mutilated drum actuator;
2. longitudinally displaceable selection gears movable along said drum, said gears being concentrically arranged around the periphery of said actuator;
3. a first register driven by said selection gears;
4. a second mutilated drum actuator for a second register;
5. longitudinally displaceable selection gears movable along said second drum;
6. a second register driven by said selection gears;
7. a cylindrical drive shaft for driving said actuators; and
8. a printing drum mounted on said drive shaft for printing postage on mail matter;

said selection mechanism comprising in each order:

a. a main selection bar;

b. manual means for differentially adjusting said selection bar;

c. means carried by said selection bar for adjusting the first register selection gear along its mutilated drum actuator;

d. an auxiliary selection bar for said second register, said auxiliary selection bar being attached to said main selection bar for movement therewith;

e. means carried by said auxiliary selection bar for adjusting the second register selection gear longitudinally along the second mutilated drum actuator;

f. means for detenting said selection bar in an adjusted position;

g. means for displaying the differential value set in said selection bar;

h. a restore cam having nine cam faces to restore said selection bar step-by-step to its zero position;

i. a rack on said selection bar and in one angular position of said rack adapted to be engaged by said restore cam to restore said bar to its zero position and in another angular position of said selection bar to be disengaged from said restore cam;

j. a locking plate;

k. a second rack on said bar, in the first angular position of said bar to be disengaged from said locking plate and the second angular position of said bar to engage said locking plate to prevent movement of said bar;

l. an interior value setting rack mounted in the interior of said cylindrical drive shaft;

m. a gear train for moving said interior rack differentially connecting said interior rack with said selection bar;

n. an exterior setting rack journalled within a slot in the exterior wall of said main drive shaft adapted to set mechanism in said print head;

o. means for connecting said exterior setting rack with said interior rack through the wall of said cylindrical drive shaft through a full rotation of said drive shaft;

p. means for resiliently detenting said selection bar in a set position; and manual means for rotating said selection bars.

14. The apparatus of claim 1 wherein said selection mechanism comprises:

1. a plurality of register drive shafts circumferentially arranged around said actuator;
2. selection gears slidably but non-rotatably mounted on some of said shafts and adapted to be engaged by a mutilated drum actuator;
3. a tens-transfer gear slidably but non-rotatably mounted on each of said shafts;
4. a register driving gear rigidly mounted on each of said shafts;
5. a dial driven by each of said register driving gears;
6. a tens-transfer gear on each of said shafts except the lowest order; and
7. means operated by the passage of a dial between its 0 and 9 value positions for positioning said tens-transfer gear into a position to be driven by said actuator.

* * * * *